United States Patent [19]

Hicks et al.

[11] Patent Number: 4,952,297

[45] Date of Patent: Aug. 28, 1990

[54] STORAGE, TRANSPORTATION AND INSTALLATION CONTAINER FOR ION-EXCHANGE MEMBRANES

[75] Inventors: Roy L. Hicks; James F. McDonnel, Jr., both of Lake Jackson, Tex.

[73] Assignee: The Dow Chemical Company, Midland, Mich.

[21] Appl. No.: 220,057

[22] Filed: Jul. 15, 1988

[51] Int. Cl.[5] ..... C25B 9/00; C25B 13/02; C25B 13/08

[52] U.S. Cl. ..... 204/255; 204/257; 204/263; 204/279; 204/296

[58] Field of Search ..... 204/279, 255, 257, 263, 204/296; 242/149; 206/449

[56] References Cited

U.S. PATENT DOCUMENTS 3,635,334 1/1972 Collins ..... 206/449 X 4,170,535 10/1979 Smura ..... 204/279

4,367,134 1/1983 Kircher ..... 204/257 X 4,792,386 12/1988 McMichael ..... 204/279

*Primary Examiner*—Donald R. Valentine

*Attorney, Agent, or Firm*—W. J. Lee

[57] ABSTRACT

A storage, transportation and installation apparatus for ion exchange membranes for bipolar ion-exchange membrane chlorine cells which protects the ion-exchange membrane from the environment. The apparatus includes a container which allows the wet membrane, or a series of membranes separated by plastic sheets to lay flat inside the container protected by a plastic sheet. The container has a roller tension bar across one end which allows each membrane to be pulled out of the container directly into the area between the anode and cathode of the cell for mounting into place.

13 Claims, 2 Drawing Sheets

STORAGE, TRANSPORTATION AND INSTALLATION CONTAINER FOR ION-EXCHANGE MEMBRANES

BACKGROUND OF THE INVENTION

This invention relates to an apparatus and method for storing, transporting and installing a sheet-like member between two adjacent opposing planar members. More particularly, this invention relates to an apparatus and method for storing, transporting and installing membrane members between electrode frame members of an electrolyzer of the filter press type.

Electrolytic cells of the filter press-type are known to be used for the electrolysis of aqueous salt solutions and have been commercially employed for the production of chlorine and caustic from brine. The filter press type electrolyzer for electrolysis of an aqueous salt solution commonly employ a plurality of electrolytic cell frame members or units with electrodes held thereto and assembled in a filter press type arrangement, separated from each other by membranes, diaphragms or microporous separators, forming a plurality of anolyte and catholyte compartments. The electrodes used in the cells are generally either monopolar or bipolar electrodes.

Membranes typically used in the cells are generally available in sheet form and have ion exchange properties, for example, membrane materials employed in the cells are such as those marketed by E. I. duPont de Nemours and Company under the trademark NAFION and by Asahi Glass Company Ltd. under the trademark FLEMION.

In ion-exchange membrane chlorine cells of the filter press type, some ion-exchange membranes used in the cells have to be placed between the bipolar or monopolar chlorine cell units and remain wet with salt water as long as possible until the cells begin to produce chlorine and caustic product. Membranes can be ruined, for example, if the membrane is exposed to the atmosphere for any great length of time and it dries out. A membrane can dry out in the length of time it takes to install the membrane in an electrolyzer. Some electrolyzers are made up of as many as 60 or more electrolytic cell units in series and therefore 60 or more of the ion-exchange membranes have to be installed between the cells. The membrane in sheet form is very similar to fabric, normally in a size of about 4 feet by 10 feet or 5 feet by 12 feet. When electrolyzers utilizing the membranes are located outdoors, the installation of the membranes within the cells would expose the membranes to dust, wind and sun.

Previous techniques of installing the membranes included tentering the membrane by hand beside the electrolyzer and then raising the membranes up and over the electrolytic cell units. The membrane, when using this technique, is exposed to the outdoor environment and is lowered from the top of the cell units down between the cell units. Handling problems do occur due to having to raise and position the membrane over the chlorine cell units and being careful to avoid wrinkling or tearing the membrane.

It would be desirous to provide a container which would conceal and store the membrane until the moment required for installing the membrane between the cell units to minimize the membrane being in contact with the elements such as wind and sun which could damage the membrane before it is used.

The advantage of the present invention over the prior art methods is that the exposure of the membranes to the outdoor environment and wrinkling of the membranes is minimized when being suspended openly.

SUMMARY OF THE INVENTION

This invention is directed to a combination storage, transportation and installation container apparatus for sheet-like members such as ion exchange membranes for bipolar or monopolar ion-exchange membrane chlorine cells. The container includes (a) at least four side walls and a bottom and is adapted for receiving at least one sheet-like member in a substantially planar position inside the container and (b) a roller tension bar member disposed across at least two parallel side walls of the container, the tension bar member adapted for guiding a sheet-like member being removed from inside the container to a use point. The container protects the membrane from the environment, and maintains the membrane wet if desired. The container may be used to install membranes in electrolzer by pulling out of the membrane from the container directly into the area between an anode and cathode of an electrolytic cell for mounting the membrane into place.

DETAILED DESCRIPTION OF THE PREFERRED EMBODIMENTS

Figure 1:
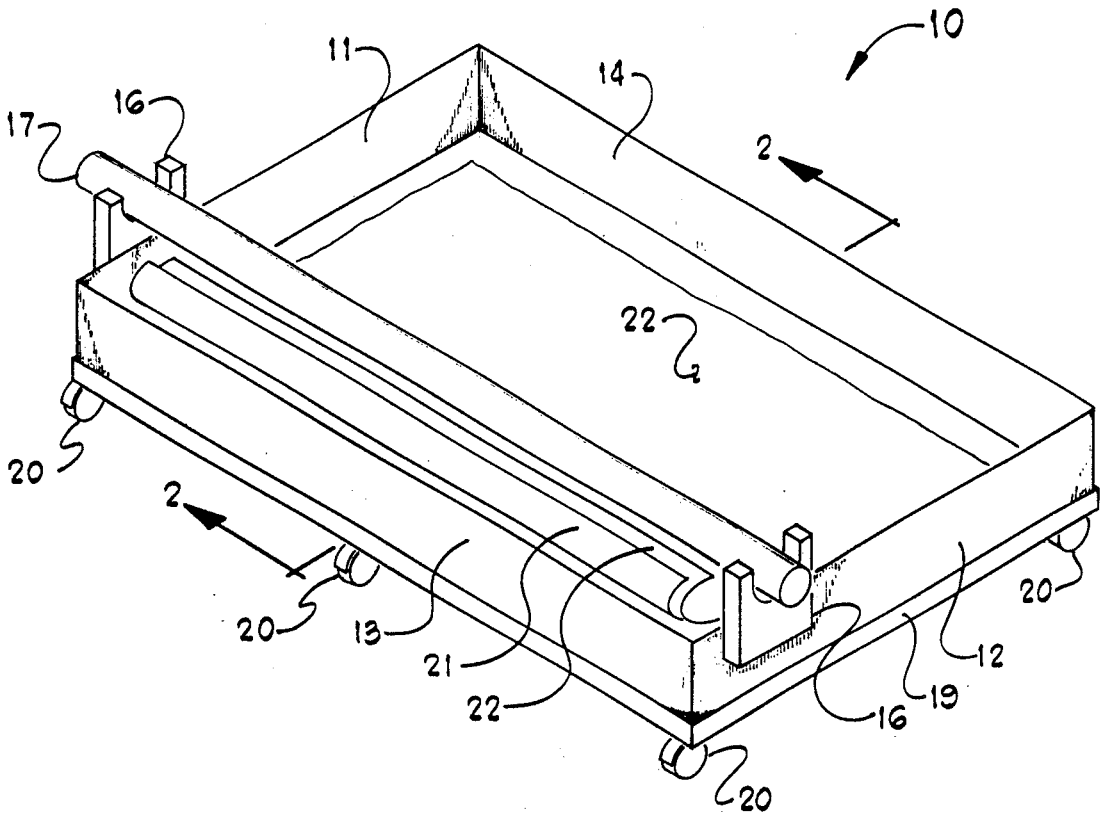
FIG. 1 is a perspective view showing a container of the present invention.
Figure 2:
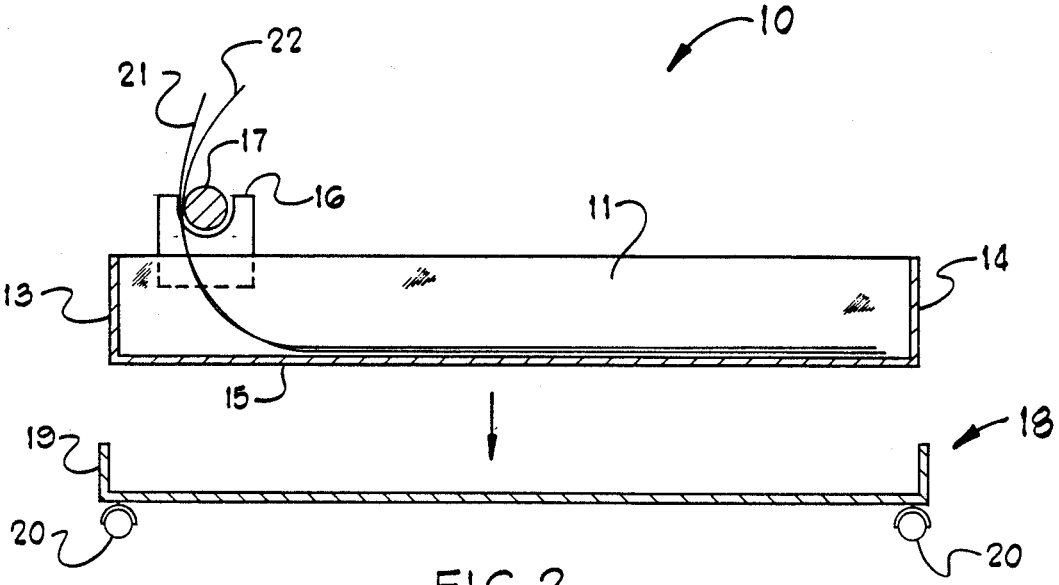
FIG. 2 is a cross-sectional view taken along line 2—2 of FIG. 1 showing a container of the present invention.

With reference to FIGS. 1 and 2, there is shown a container of the present invention, generally indicated by numeral 10, with several sheet-like members 21 placed in the container 10. The container 10 includes four side walls 11–14 and a bottom 15. In this instance the container is box-like and rectangular in shape with side walls 11 and 12 parallel to each other and 13 and 14 parallel to each other. Other shapes of the container, such as square or circular, can be used. This will depend, to some extent, on the shape of the sheet-like member.

Roller bar support members 16 on side walls 11 and 12 hold a roller tension bar member 17 extending on top of and across the length of the container 10. The roller tension bar 17 is adapted for guiding a sheet-like member such as a membrane 21 and keeping it planar as it exits the container 10. The roller tension bar 17 is preferably rotatably mounted in the container 10. One side of the membrane contacts the length of the roller tension bar 17 as the membrane is removed from the inside of the container 10 to a use point outside the container. The roller tension bar 17 preferably rotates as the membrane, for example, is pulled across the surface of the roller bar to maintain contact with the surface of one side of the membrane until it is removed from the container.

It is preferred to place roller means generally indicated by numeral 18 on the bottom of the container 10 for ease of moving the container from one location to another. In this instance, the roller means 18 includes a support frame 19 with casters 20 attached to the bottom of the support frame 19. The container 10 is removably mounted on the support frame 19 or, if desired, the bottom wall 15 may be attached to the support frame 19. The roller means 18 allows the container 10 to be rolled to a use location. In another embodiment, the casters 20 may be attached directly to the bottom wall 15 of the container 10. Other means for moving the container to the location for its use can also be used such as by lifting the container with a lifting device.

The materials of construction for the container and support frame are conventional such as metal or plastic having sufficient strength to support the handling of loads placed thereon.

The container 10 can contain a single or plurality of sheet-like members such as membranes 21 with or without a clamping means (not shown) attached to the top edge of each membrane for ease of removing the membrane from the container. The membranes 21 are preferably ion-exchange membranes. When a plurality of electrolytic cell units are assembled in operable combination, an ion exchange membrane is positioned between adjoining electrolytic units. The type of ion exchange membrane used in the present invention is not critical. Representative of the types of ion exchange membrane suitable for use in assembling a plurality of electrolytic units are disclosed in the following U.S. Pat. Nos. 3,909,378: 4,025,405: 4,065,366; 4,116,888; 4,123,336: 4,126,588; 4,151,053: 4,176,215: 4,178,218; 4,192,725: 4,209,635: 4,212,713: 4,251,333: 4,270,996: 4,329,435: 4,330,654: 4,337,137: 4,337,211: 4,340,680; 4,357,218; 4,358,412: and 4,358,545. These patents are hereby incorporated by reference for the purpose of the membranes they disclose.

The ion exchange membrane 21 may preferably contain sulfonic ion exchange groups, carboxylic ion exchange groups, or both sulfonic and carboxylic acid ion exchange groups. Optionally, the ion exchange membrane may be a bi-layer membrane having one type of ion exchange active sites in one layer and another type of ion exchange active sites in the other layer. The membrane may be reinforced to impair deforming during electrolysis or it may be unreinforced to maximize the electrical conductivity throughout the membrane.

In placing the membrane in the container 10, it is preferred to lay the membranes 21 planar to each other in a layered fashion with a flexible protective sheet member 22 interposed between the membranes 21. Optionally, one sheet member 22 may cover the bottom of the container 10 to avoid abrasive damage to the membranes 21. Any material which is used for the sheet member 22 should be inert to alkaline solution used in the container 10 and non-abrasive to the membrane 21. The protective sheet members 22 may be made of, for example, a plastic such as polyethylene or fluorocarbon plastic such as TEFLON®. Preferably, a single protective sheet cover member 22 is used to cover a single membrane 21 and is positioned between the membranes for separating from each other and protecting the membranes from abrasion from each other.

The container 10 may contain a liquid for maintaining the membrane wetted until it is used. The liquid may be, for example, an aqueous alkaline solution such as NaCl solution (brine), weak caustic solution and sodium carbonate solution and the like. The placing of the membrane 21 and protective sheet member 22 should be carried out inside an environmentally controlled handling facility such as a clean, air-conditioned or heated room to prevent exposing the membranes to the elements. A protective sheet member 22 is laid on top of the last membrane 21 in the container or the container is covered with a removable container top (not shown) to keep out dust and sunlight as the container is transported outdoors to a vicinity near the electrolyzer area.

Figure 3:
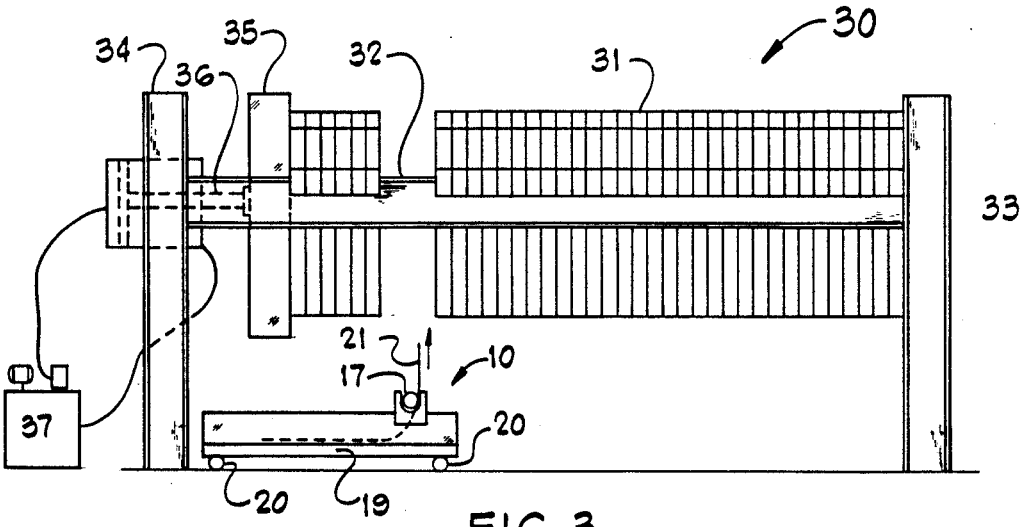
FIG. 3 is side view showing a container of the present invention being used to install a membrane in an electrolysis cell.

With reference to FIG. 3, there is shown an electrolyzer generally indicated as numeral 30 with a container 10 underneath the electrolyzer 30. Generally, the electrolyzer 30 comprises a series of electrolytic cell units 31 supported on rails 32 which in turn are supported by two stationary platens 33 and 34. A compressor means such as a moveable platen 35 attached to hydraulic jacks 36 and a hydraulic reservoir 37 is used to compress the electrolytic cell units 31 together in a fluid-tight arrangement. The container 10 may be transported to the electrolyzer 30, for example, by fork lift or the container 10 may be rolled out to the electrolyzer work area via the roller means 18. With the container positioned adjacent to the series of electrolytic cell units, the container 10 is then set underneath the series of electrolytic cell units by rolling the container via its roller coasters 20. Preferably, the coasters 20 should allow the container to be moved bi-directionally.

Preferred filter press type electrolytic cell units for employing the present invention are bipolar or monopolar membrane cells in which the electrolytic cell units are oriented vertically as shown in FIG. 3. Suitable bipolar filter press membrane electrolytic cell units include, for example, those described in U.S. Pat. No. 4,488,946, issued Dec. 18, 1984 to Morris et al. Suitable filter press monopolar membrane electrolytic cells include, for example, those described in U.S. Pat. No. 4,056,458, issued Nov. 1, 1977, to G. R. Pohto et al.; U.S. Pat. No. 4,210,516, issued July 1, 1980, to L. Mose et al. and U.S. Pat. No. 4,217,199, issued Aug. 12, 1980, to H. Cunningham.

The electrolytic cell comprises an anode or a plurality of anodes and a cathode or a plurality of cathodes, and one or more gaskets of the present invention compressed together with a membrane between each anode and adjacent cathode which divides the cell into separate anode and cathode compartments.

The electrolytic cell is equipped with means for charging electrolyte to the cell and with means for removing the products of electrolysis from the cell. In particular, the anode compartments of the cell are provided with means for feeding aqueous alkali metal chloride electrolyte to the cell, suitably from a common header, and with means for removing products of electrolysis from the cell. Similarly, the cathode compartments of the cell are provided with means for removing products of electrolysis from the cell, and optionally with means for feeding water or other fluid to the cell. The electrolysis process may be operated by charging electrolyte to the electrolytic cell, electrolyzing the electrolyte therein, and removing the products of electrolysis from the electrolytic cell.

Again, with reference to FIG. 3, in a preferred embodiment of carrying out a process of the present invention, the container 10 is rolled under the series of cells 30 and positioned directly below a space between a cell-to-cell opening. A rope or pulling means (not shown) is then lowered down through the space created by separated cell units from overhead the cell units. The pulling means are held by operating personnel who are standing above the opening. The top edge of the first membrane 21 is attached to the pulling means. The pulling means is then used to pull the membrane up through the opening manually. As the pulling means moves upward, the membrane 21 is pulled out of the container 10 and against the underside of the roller tension bar 17. The protective sheet member 22 is placed between the membrane 21 and the tension bar 17.

The membrane 21 is pulled from the container 10 until the free bottom edge can be held by hand and located properly against the bipolar cell unit. The cell-to-cell opening is closed up after proper positioning of the membrane against the gaskets and the cells are pressed into position by a conventional cell press means. The container is then repositioned, if required, underneath the next cell-to-cell opening and the process is repeated until all membranes in the container are used. The container is then rolled out from under the series of cells and transferred back to the handling room by forklift or casters. Several more membranes are laid in the container as described above with alternate layers of polyethylene and the handling process is repeated at the series site until the desired number of membranes are installed in an electrolyzer unit.

Figure 4:
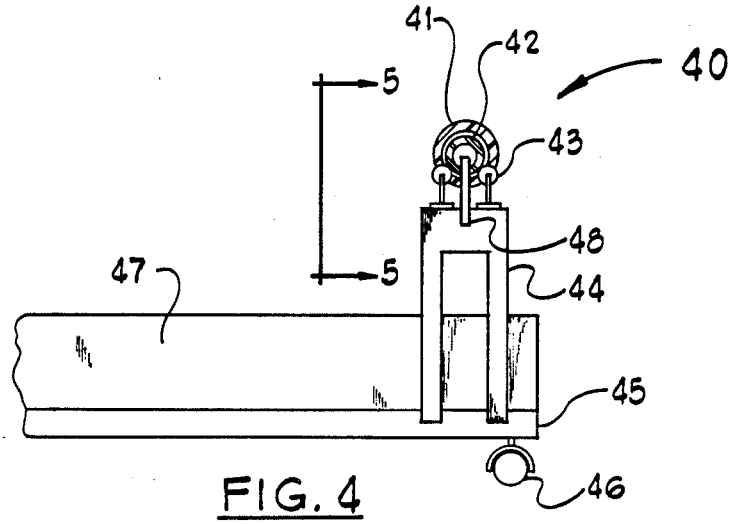
FIG. 4 is a fragmentary side view showing another embodiment of a roller tension bar in a container of the present invention.
Figure 5:
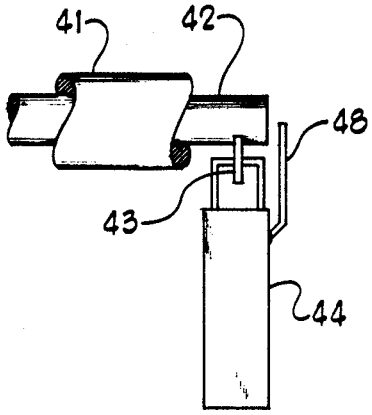
FIG. 5 is a side view taken along line 5—5 of FIG. 4 showing the roller tension bar of FIG. 4.
Figure 6:
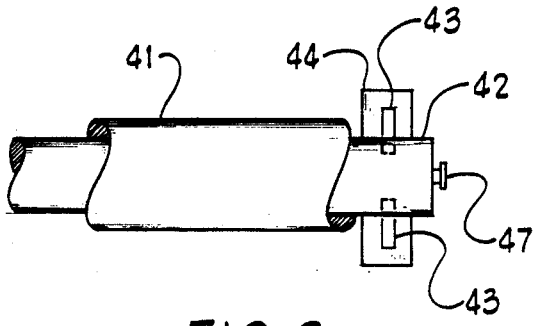
FIG. 6 is a top view of the roller tension bar of FIG. 4.

Referring to FIGS. 4, 5 and 6, there is shown another embodiment of a roller tension bar 40 including a pipe member 41 with a pipe member 42 concentrically disposed therein. The pipe member 41 is wrapped around pipe member 42 and is capable of freely spinning around the pipe member 42, i.e., it is not attached to the pipe member 42, however pipe member 41 could be securely attached to pipe member 42 if desired. Roller means 43 are rotatably mounted on a support member 44 which is preferably attached to a bottom member 45 with casters 46. A container 47 is mounted on the bottom member 45. The roller tension bar 40 is rotatably mounted on the roller means 43. In operation, the membrane surface contacts the tension 40 bar which rotates on the roller means to minimize abrasion and frictional forces which may damage the membrane as it exits the container. A stop piece 48 prevents the tension bar 40 from sliding off the roller means 43 and maintains the tension bar 40 in position.

What is claimed is:

1. A combination storage, transportation and installation container for ion-exchange membranes comprising (a) a container with at least four sides and a bottom, said container adapted for receiving at least one ion-exchange membrane in a substantially horizontal, planar position inside the container and (b) a roller tension bar member disposed across at least two parallel side walls of the container near the end thereof, said tension bar member adapted for guiding an ion-exchange membrane being removed upwardly from inside the container to a use point above the container.

2. The container of claim 1 wherein the membrane is an ion-exchange membrane for filter press-type electrolytic cells.

3. The container of claim 1 including a means for protecting the ion-exchanger membrane from the environment.

4. The container of claim 1 including a removable top member for closing the container to the atmosphere.

5. The container of claim 1 wherein the container is opened at the top to the atmosphere.

6. The container of claim 1 containing a plurality of ion-exchange membranes.

7. A combination storage, transportation and installation container for sheet-like members comprising (a) a container with at least four side walls and a bottom, said container adapted for receiving at least one sheet-like member in a substantially planar position inside the container, (b) a roller tension bar member disposed across at least two parallel side walls of the container, said tension bar member adapted for guiding a sheet-like member being removed from inside the container to a use point, and (c) a wetting fluid inside the container for wetting the sheet-like members.

8. A combination storage, transportation and installation container for sheet-like members comprising (a) a container with at least four side walls and a bottom, said container adapted for receiving at least one sheet-like member in a substantially planar position inside the container, (b) a roller tension bar member disposed across at least two parallel side walls of the container, said tension bar member adapted for guiding a sheet-like member being removed from inside the container to a use point, and (c) a protective sheet-like cover member disposed above and below the sheet-like member for separating and protecting the sheet-like member.

9. A combination storage, transportation and installation container for sheet-like members comprising (a) a container with at least four side walls and a bottom, said container adapted for receiving at least one sheet-like member in a substantially planar position inside the container and (b) a roller tension bar member disposed across at least two parallel side walls of the container and rotatably mounted to said container, said tension bar member adapted for guiding a sheet-like member being removed from inside the container to a use point.

10. A combination storage, transportation and installation container for sheet-like members comprising (a) a container with at least four side walls and a bottom, said container adapted for receiving at least one sheet-like member in a substantially planar position inside the container, (b) a roller tension bar member disposed across at least two parallel side walls of the container, said tension bar member adapted for guiding a sheet-like member being removed from inside the container to a use point, and (c) a roller means for moving the container.

11. The container of claim 10 wherein the roller means includes at least four casters removably attached to a support frame member disposed under the container.

12. The container of claim 10 wherein the roller means includes at least four casters removably attached to the bottom of the container.

13. A method of installing a membrane between adjacent vertical frame members of an electrolytic cell, said method comprising:

(a) providing at least one horizontal, planar membrane in an enclosed container positioned below the frame members:

(b) providing at least one of said membrane(s) upwardly from the container to a vertical position between the frame members; and (c) compressing the membrane between the frame members.

* * * * *

UNITED STATES PATENT AND TRADEMARK OFFICE

CERTIFICATE OF CORRECTION

PATENT NO. : 4,952,297

DATED : August 28, 1990

INVENTOR(S) : Roy L. Hicks, James F. McDonnel, Jr.

It is certified that error appears in the above-identified patent and that said Letters Patent is hereby corrected as shown below:

Col. 4, line 31, shown as; "roller coasters 20" should read --roller casters 20--.

Col. 4, line 31 shown as; "the coasters 20" should read --the casters 20--.

Col. 6, line 63, shown as; "providing" should read --removing--.

Signed and Sealed this

Third Day of November, 1992

*Attest:*

*Attesting Officer*

DOUGLAS B. COMER

*Acting Commissioner of Patents and Trademarks*